US006064288A

United States Patent [19]

Norman et al.

[11] Patent Number: 6,064,288

[45] Date of Patent: May 16, 2000

[54] COAXIAL ROTARY COUPLER

[75] Inventors: Douglas A. Norman, San Jose; James P. Scherer, Los Altos, both of Calif.

[73] Assignee: L3 Communications Corp., Randtron Antenna Systems Division, Menlo Park, Calif.

[21] Appl. No.: 09/118,185

[22] Filed: Jul. 17, 1998

[51] Int. Cl.[7] ..... H01P 1/06

[52] U.S. Cl. ..... 333/261; 343/763

[58] Field of Search ..... 333/261; 343/763, 343/766

[56] References Cited

U.S. PATENT DOCUMENTS 4,233,580 11/1980 Treczka et al. ..... 333/261
4,258,365 3/1981 Hockham et al. ..... 333/261 X
4,677,405 6/1987 Gray ..... 333/261 X
5,233,320 8/1993 Evans ..... 333/261

OTHER PUBLICATIONS

Ragan, "Microwave Transmission Circuits", pp. 416–425 and pp. 452–455.; 1948.

*Primary Examiner*—Paul Gensler
*Attorney, Agent, or Firm*—Flehr Hohbach Test Albritton & Herbert LLP

[57] ABSTRACT

A coaxial rotary coupler assembly which includes a coaxial transmission region for transmitting RF energy between a stationary and rotating section of the rotary coupler. Compact stubs are associated with the input and output connections to associated input and output transmission lines. Stepped impedance chokes are formed between fixed and rotating portions of the outer and inner coaxial conductors of the rotary transmission line sections.

5 Claims, 4 Drawing Sheets

COAXIAL ROTARY COUPLER

BRIEF DESCRIPTION OF THE INVENTION

This invention relates generally to a rotary coupler for transferring energy between a stationary and a rotating section of a coaxial transmission line.

BACKGROUND OF THE INVENTION

Radar systems having rotary antenna arrays are used in aircraft surveillance systems, on board ships and on land mounted radar installations. The elements of the antenna array must be individually fed from an RF transmission line. Rotary couplers are employed to transfer or transmit RF energy from the mixed equipment to the antenna elements. In general, the antenna arrays require rotary couplers capable of providing RF energy to, and receiving RF energy from, the multiple antenna elements through separate transmission lines. In the past, coaxial rotary couplers for multiple transmission lines have been large and cumbersome. There is a need for a compact coaxial rotary coupler.

OBJECTS AND SUMMARY OF THE INVENTION

It is a general object of the present invention to provide a coaxial rotary coupler for transferring energy between a stationary and a rotating section of a coaxial transmission line.

It is another object of the present invention to provide a coaxial rotary coupler that is significantly more compact than prior art rotary couplers.

It is a further object of the present invention to provide a rotary coupler which transfers RF energy between a stationary and rotating section of a coaxial transmission line with minimum perturbations.

It is still a further object of the present invention to provide a multi-channel compact coaxial rotary coupler.

The foregoing and other objects of the invention are achieved by a coaxial rotary coupler assembly which includes a coaxial transmission region for transmitting RF energy between a stationary and rotating section of the rotary coupler. Compact stubs are associated with the input and output connections to associated input and output transmission lines. Stepped impedance chokes are formed between fixed and rotating portions of the outer and inner coaxial conductors of the rotary transmission line sections.

BRIEF DESCRIPTION OF THE DRAWINGS

The foregoing and other objects will be more clearly understood from the following description when read in connection with the accompanying drawings of which.

DESCRIPTION OF THE PREFERRED EMBODIMENT

Figure 1:
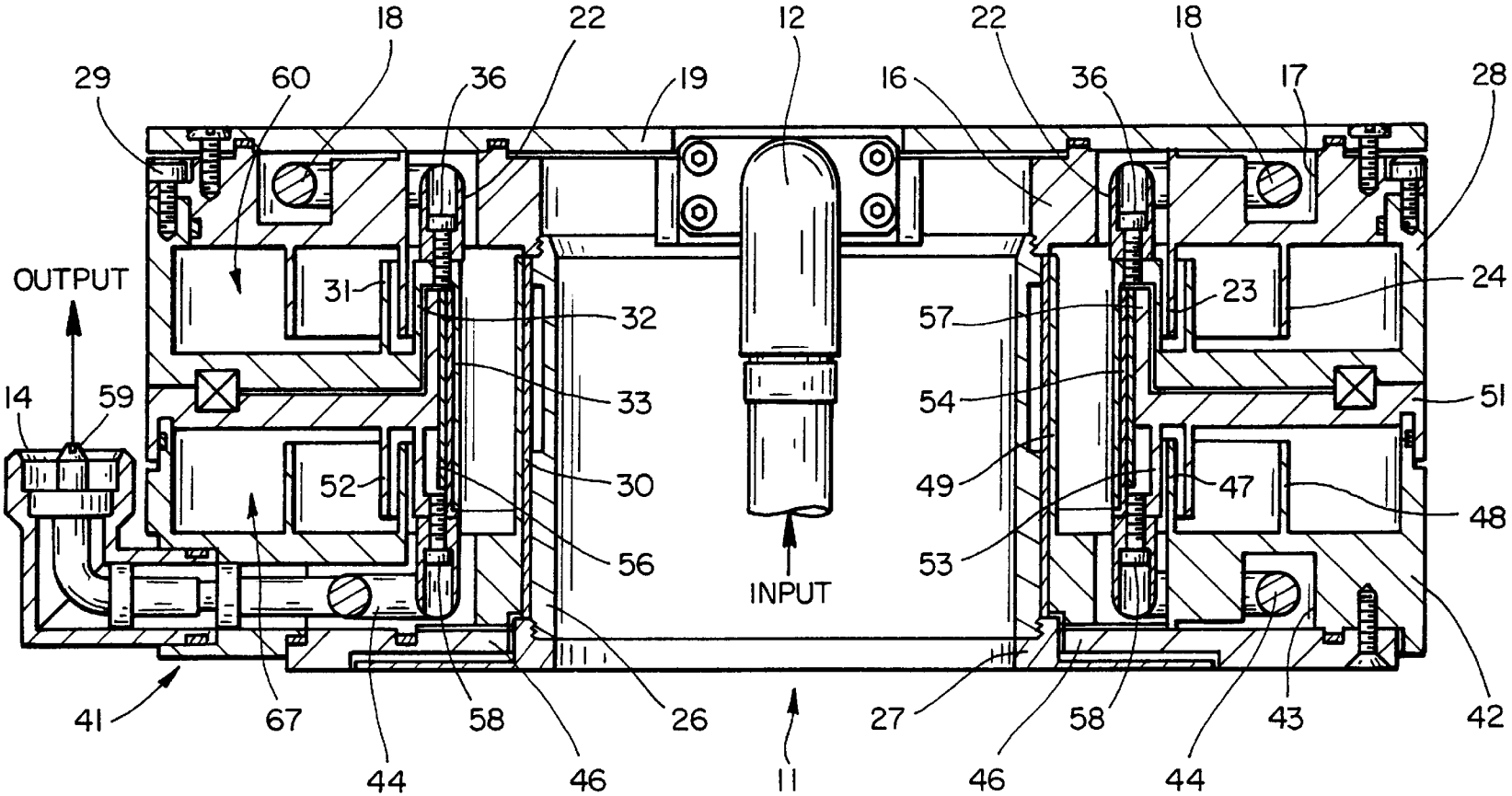
FIG. 1 is a cross-sectional view of a coaxial rotary coupler in accordance with the present invention.
Figure 2:
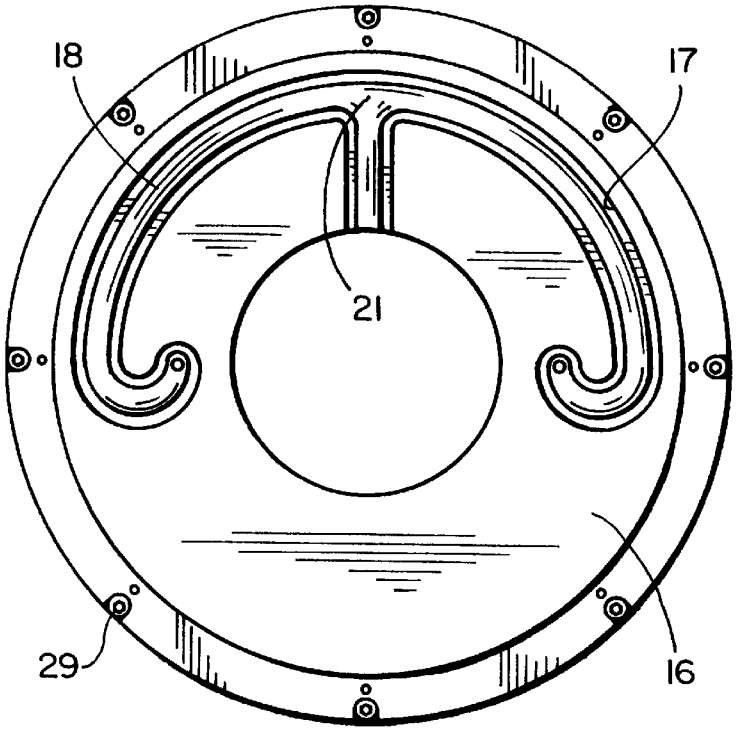
FIG. 2 is a top plan view with the top plate removed showing the wishbone RF energy feed for the coaxial rotary coupler of the present invention.

Referring to FIG. 1, a coaxial rotary coupler 11 is shown with an input 12 connected to the stationary part of the rotary coupler and an output 14 associated with the rotating section of the rotary coupler. The stationary part of the rotary coupler includes an upper section 16 which includes a semi-circular groove 17, FIGS. 1, 2 and 3, which receives a conductor 18. A cover plate 19 is secured to the member 16 and defines, with the groove 17, the outer conductor of a coaxial transmission line section, having the conductor 18 as the center conductor. The transmission line section is in the form of a wishbone and is fed with RF energy at the center 21 and transfers the energy to the downward depending portions 22 which are attached to the outer conductor of the coupler coaxial transmission line section, as will be presently described. The upper section 16 includes cylindrical portions 23 and 24. A cylinder 26 is suitably attached to the upper section 16, as for example, by welding, and extends downwardly to engage a disk 27. A cylinder 30 is secured to the upper end of the cylinder 26 and is spaced from the other end. The stationary part includes a lower member 28 secured to the upper section 16, as for example, by screws 29. The lower member includes cylindrical member 31, which is spaced from the member 23. The section 16 includes cylindrical portion 32 which extends adjacent the other side of cylindrical portion 23 and then extends in the opposite direction as cylindrical portion 33 which forms the outer conductor of the rotary coupler transmission line section.

The end of the conductor 18 of the wishbone transmission line is suitably secured to the portion 32, as for example, by the screws 36. Thus, the conductor 18 feeds the outer conductor 33 at two spaced points 180° around the cylindrical outer conductor 33. This improves coupling, reduces the input impedance to the matching section, distributes the energy more evenly, and improves the match to the coupler, decreases the insertion loss and VSWR to the input port, and avoids higher order modes.

The rotating portion 41 of the rotary coupler includes a section 42 provided with a semi-circular groove 43 and a center conductor 44 of an output wishbone coaxial transmission line. Bottom plate 46 completes the outer conductor for the coaxial transmission line defined by the groove 43 and center conductor 44. The section 42 includes cylindrical members 46 and 47. The section 42 also includes a cylinder 49 which defines the inner conductor of the rotary transmission line section. The rotary portion 41 includes a second section 51 with cylindrical member 52 adjacent member 47. A second cylindrical member has a portion 53 adjacent the other side of member 47. A cylinder 54 is secured to the portion 53. A second cylinder 56 is secured to the portion 57 of the member 51 and is spaced from the member 54. The wishbone semi-circular transmission line section is connected by screws 58 to the portion 53 and provides the output at terminal 59. As discussed with respect to the input the wishbone output provides a coupling which reduces output impedance to the matching section, distributes the energy more equally, improves match from the coupler to the associated transmission line, and decreases VSWR to the output port, and avoids higher order modes.

Figure 4:
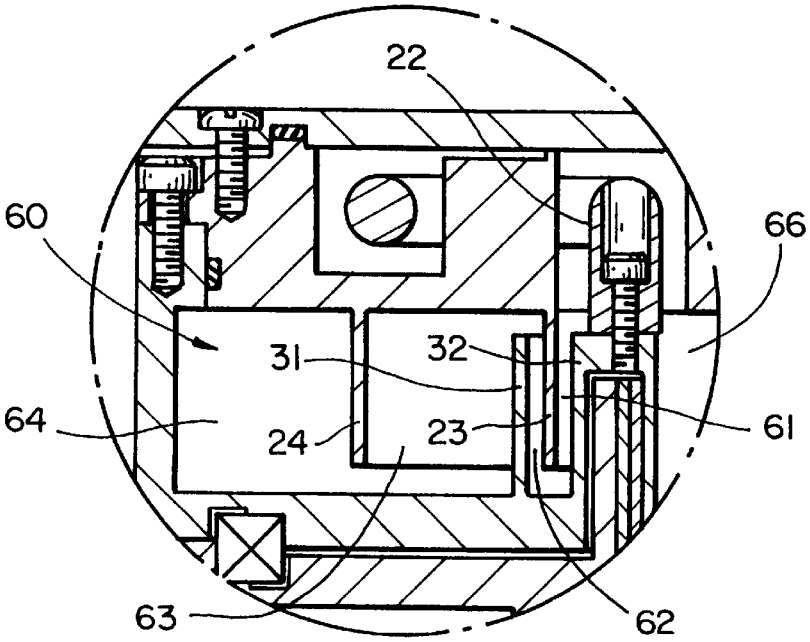
FIG. 4 is an enlarged view of the stub associated with the input feed to the rotary coupler.
Figure 3:
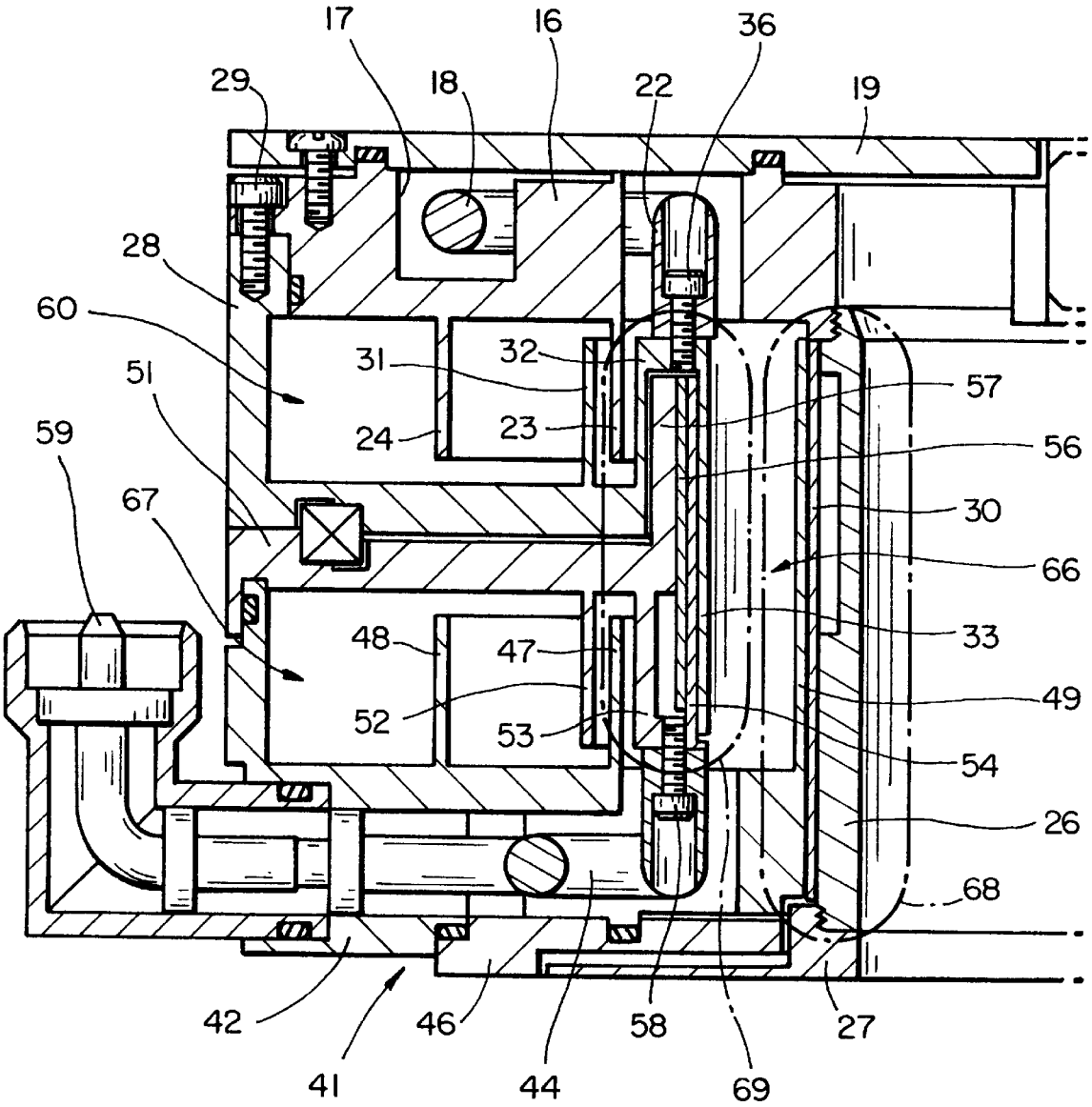
FIG. 3 is an enlarged view of the left hand half of the rotary coupler shown in FIG. 1.

FIGS. 3 and 4 show an enlarged view of the left hand portion of the coupler of FIG. 1, and an enlarged view of the portions delineated by the dotted lines of FIG. 1, where like reference numerals have been applied to like parts. The interleaved cylindrical members 24 and 31 extending from the members 16 and 28 provide an impedance matching section or stub for the RF energy input to the rotary coupler. More particularly, the space 61 between the cylindrical members 23 and 32 provides a first low impedance section for the matching stub 60. The space 62 between the cylindrical member 23 and cylindrical member 31 provides a second low impedance section while the region between the spaced cylindrical members 24 an 31 forms a first high impedance section 63 while the region between the cylindrical member 24 and the outer wall of the member 28 provides a second high impedance section 64. The action of these impedance step matching stub sections provides an impedance match between the coaxial input line and the coaxial coupling region 66.

The impedance step matching stub 67 associated with the output transmission line is similar in construction and is therefore not described in detail. Thus, a short circuited stub network 60 begins with two narrow sections which represent very low impedance transmission lines. These coaxial sections are then folded in series by two wide folded sections which represent high impedance transmission lines. Finally the section ends under physical short circuit. The sections are folded by using the outer diameter of neighboring sections as inner conductor of an impedance section and vice versa. This low/low high/high impedance transformation allows the shorted end of the second high impedance section to present an RF open circuit near the first low impedance end where the feed circuit meets the coupling region.

Figure 5:
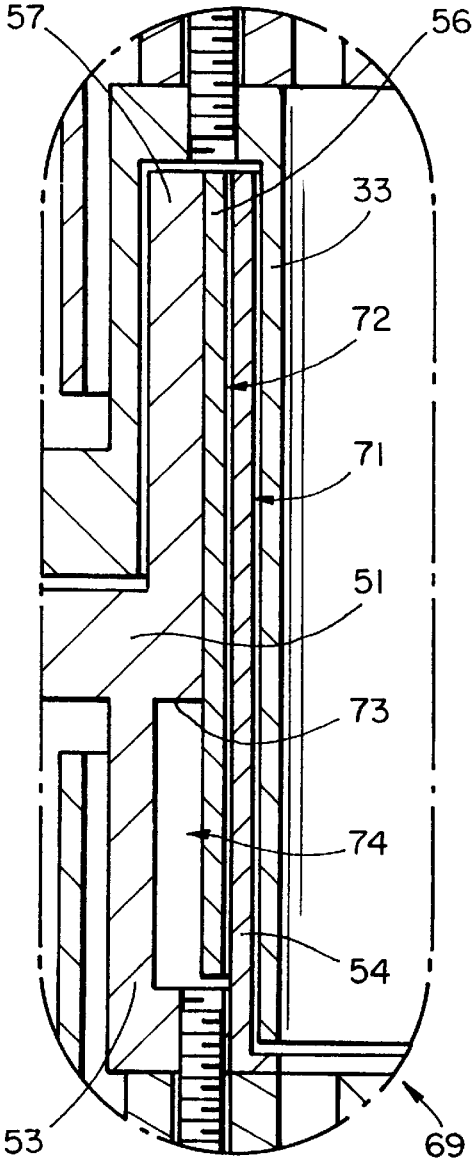
FIG. 5 is an enlarged view of the outer choke assembly associated with the outer transmission line section.
Figure 6:
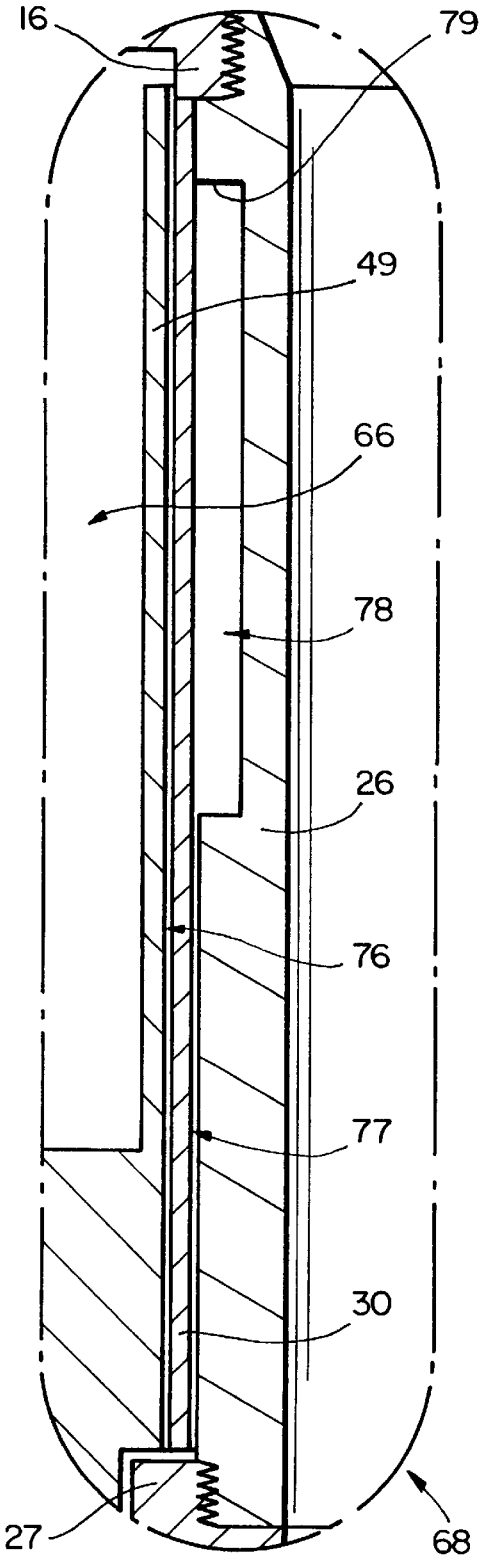
FIG. 6 is an enlarged view of the choke assembly associated with the inner coaxial transmission line section.

Inner and outer chokes 68, 69 formed by the interleaved cylindrical members of the rotating and stationary portions of the rotary coupler are provided to insure the transmission of energy across the gap between the rotating and stationary portions. The outer choke 69 is shown in FIGS. 1, 3 and 5. The inner choke 68 is shown in FIGS. 1, 3 and 6. The inner choke 68 is formed just inboard of the inner conductor cylinder 48 of the coaxial coupling region 66, while the outer choke is found just outboard of the outer conductor cylinder 33 of the coaxial coupling region. The outer choke includes an input leg 71 defined by the space between the fixed outer conductor 33 and the rotating cylindrical conductor 54. A middle leg 72 of the choke is formed between the rotating cylindrical conductors 54, 56. The cylindrical conductor 51 includes a slot 73 formed in the rotating member which (cooperates with cylindrical member 56 to form the back leg 74 of the choke.

Similarly, the inner choke includes an input leg 76 defined by the rotating inner conductor 48 and cylindrical conductor 30, depending from the stationary member 26. A middle leg 77 is formed between the cylindrical members 26 and 30 while a back leg 78 is formed between the member 30 and the slot 79 formed in the member 26. The inner and outer chokes employ the novel technique of multiple impedance sections to reduce the length of the choke. Impedance sections are folded about one another by using the outer diameter of one leg to form the inner conductor of an adjacent impedance section, and vice versa.

Typically choke lengths are one-half of a wavelength long. By employing the special design of the present invention, chokes having overall physical length of 0.0723wavelengths for the inner choke, and 0.043 wavelengths for the outer choke have been achieved. The usual matching stubs are typically one-fourth wavelength long. In accordance with the present invention, the matching stubs have an overall physical length of approximately 0.025 wavelength. The foregoing is achieved by using multiple impedance sections, as well as folding these various impedance sections about one another.

Thus there has been provided a compact rotary coupler.

What is claimed is:

1. A coaxial rotary RF coupler for transferring RF energy from a stationary section to a rotating section of a coaxial transmission line comprising an inner conductor having rotating and stationary cylindrical members, said cylindrical members configured to form an inner RF choke, an outer conductor having rotating and stationary cylindrical members configured to form an outer RF choke, an input coaxial transmission line connected to a stationary member of said outer conductor for supplying RF energy to said coaxial coupler, an input stub comprising a plurality of interleaved cylindrical members associated with the input coaxial line connection, and, an output coaxial transmission line connected to said rotating outer conductor for providing output energy to a coaxial transmission line, and, an output stub comprising a plurality of interleaved cylindrical members associated with the output coaxial transmission line connection.

2. A coaxial rotary coupler as in claim 1 in which said outer RF choke includes an input leg defined by a fixed cylindrical and a rotating cylindrical conductor, a middle leg defined by said rotating cylindrical conductor and a second rotating cylindrical conductor, and a back leg formed by a slot in the second rotating member.

3. A coaxial rotary coupler as in claim 1 or 2 in which said inner RF choke includes an input leg defined by a rotating cylindrical conductor and a fixed cylindrical conductor, a middle leg defined by said fixed cylindrical conductor and a spaced fixed conductor, and a back leg formed by a slot formed in said spaced fixed conductor.

4. A coaxial rotary coupler as in claim 1 in which said input and output stubs include first and second spaced cylindrical conductors extending in one direction and third and fourth spaced cylindrical conductors extending in an opposite direction interleaved with the first and second cylindrical conductors, said first cylindrical conductor being between said third and fourth cylindrical conductors and closely spaced therefrom to form low impedance transmission lines and said fourth cylindrical conductor spaced from said second cylindrical conductor to form a high impedance transmission line.

5. A coaxial rotary coupler as in claim 3 in which said input and output stubs include first and second spaced cylindrical conductors extending in one direction and third and fourth spaced cylindrical conductors extending in an opposite direction interleaved with the first and second cylindrical conductors, said first cylindrical conductor being between said third and fourth cylindrical conductors and closely spaced therefrom to form low impedance transmission lines and said fourth cylindrical conductor spaced from said second cylindrical conductor to form a high impedance transmission line.

* * * * *